United States Patent [19]

Van Erden et al.

[11] Patent Number: 4,925,316

[45] **Date of Patent: * May 15, 1990**

[54] RECLOSABLE BAG HAVING AN OUTER RECLOSABLE ZIPPER TYPE CLOSURE AND INNER NON-RECLOSABLE CLOSURE

[75] Inventors: Donald L. Van Erden, Wildwood; Hugo Boeckmann, Arlington Heights, both of Ill.

[73] Assignee: Minigrip, Inc., Orangeburg, N.Y.

[ * ] Notice: The portion of the term of this patent subsequent to Nov. 22, 2005 has been disclaimed.

[21] Appl. No.: 82,207

[22] Filed: Aug. 6, 1987

Related U.S. Application Data

[63] Continuation-in-part of Ser. No. 169,138, Mar. 10, 1988, Pat. No. 4,786,190, which is a continuation of Ser. No. 895,312, Aug. 11, 1986, abandoned.

[51] Int. Cl.[5] ..... B65D 33/18; B65D 33/20

[52] U.S. Cl. ..... 383/61; 383/63; 206/632

[58] Field of Search ..... 383/61, 63, 65; 206/632

[56] References Cited

U.S. PATENT DOCUMENTS

| | | | |
|---|---|---|---|
| 2,898,027 | 8/1959 | Scholle . | |
| 3,181,583 | 5/1965 | Lingenfelter . | |
| 3,282,493 | 11/1966 | Kamins et al. | 383/61 |
| 3,313,471 | 4/1967 | Dickard et al. | 206/632 |
| 3,456,867 | 7/1969 | Repko | 383/61 |
| 3,462,068 | 8/1969 | Suominen | 383/63 |
| 4,235,653 | 11/1980 | Ausnit | 383/63 |
| 4,241,865 | 12/1980 | Ferrell . | |
| 4,252,238 | 2/1981 | Spiegelberg et al. . | |
| 4,617,683 | 10/1986 | Christoff | 383/65 |
| 4,713,839 | 12/1987 | Peppiatt . | |
| 4,736,450 | 4/1988 | Van Erden et al. | 383/65 |
| 4,744,674 | 5/1988 | Nocek | 383/61 |
| 4,782,951 | 11/1988 | Griesbach et al. | 206/484 |

FOREIGN PATENT DOCUMENTS

| | | | |
|---|---|---|---|
| 239319 | 9/1987 | European Pat. Off. | 383/61 |
| 57-105248 | 6/1982 | Japan . | |
| 2130173 | 5/1984 | United Kingdom | 383/61 |

*Primary Examiner*—Stephen P. Garbe

*Attorney, Agent, or Firm*—Hill Van Santen, Steadman & Simpson

[57] ABSTRACT

A bag has wall panels defining a receptacle space and providing a bag mouth arrangement between upper end portions of the wall panels. A tamper evident, and if desired hermetic seal, non-reclosable closure adjacent to a reclosable zipper and located adjacently below upper end portions of the wall panels is accessible to be opened when the zipper is open. The zipper is arranged for intermittent opening and closing of the bag and its opposite ends are sealed into the side edges of the bag. The non-reclosable closure may be a peel seal or a rupturable connection.

5 Claims, 1 Drawing Sheet

RECLOSABLE BAG HAVING AN OUTER RECLOSABLE ZIPPER TYPE CLOSURE AND INNER NON-RECLOSABLE CLOSURE

This is a continuation-in-part of our copending application Ser. No. 169,138 filed Mar. 10, 1988, now U.S. Pat. No. 4,786,190 which is a continuation of Ser. No. 895,312, filed Aug. 11, 1986 (now abandoned).

BACKGROUND OF THE INVENTION

This invention relates in general to the packaging art, and is more particularly concerned with reclosable bags.

Numerous and varied reclosable bag structures have been proposed, and some have proven to be commercially quite good.

In particular, there has been some emphasis on providing tamper evident bags, and bags that are hermetically sealed until they are opened for access to the contents, whereafter a reclosable fastener device comes into play for maintaining the contents within the bag until access is again desired. By way of example, attention is directed to the following U.S. Patents as representative of various approaches to the type of bag with which the present invention relates by way of improvement:

U.S. Pat. Nos. 2,978,769 and 3,172,443 disclose non-reclosable frangible connections of fastener profiles.

U.S. Pat. No. 3,325,084 discloses a closure flap provided with closure profiles that will meet with closure profiles o the front of the bag or package.

U.S. Pat. No. 3,326,399 discloses the use of magnetic reclosable fastening means.

U.S. Pat. Nos. 3,198,288; 3,473,589 and 3,780,781 disclose reclosable profile fasteners or zippers, and a tear off top on the bag for access to the zipper.

U.S. Pat. No. 3,543,343 discloses a bag with reclosable fastener profiles and a tear cord for opening the bag.

U.S. Pat. No. 3,625,270, discloses a tear ribbon device for opening the bag.

U.S. Pat. No. 3,746,215, discloses a funnel arrangement which retains the bag sealed closed until the funnel is everted and the end snipped off.

U.S. Pat. Nos. 3,991,801; 4,191,230 and 4,235,653, disclose other arrangements of funnel bags.

U.S. Pat. No. 4,241,865, discloses a heavy duty bag to be made from paper and equipped with a primary rip cord closure and a hood thereover provided with a reclosable zipper of the interlocking teeth type.

In spite of the fairly high state of development in this art, there is still room for improvement and the attainment of simplicity and economy in dual fastener bags, that is, bags that have hermetic or at least tamper evident non-reclosable closure means and associated reclosable zippers.

SUMMARY OF THE INVENTION

An important object of the present invention is to provide a new and improved bag or package structure having non-reclosable closure means which is readily digitally openable when associated reclosable zipper means are in an open condition, the bags being reclosable by means of the zipper means.

To the attainment of that object, the present invention provides a bag having opposed wall panels permanently closed or at least permanently closable at a bottom end of the bag and at opposite sides of the bag, and comprising a bag mouth defined by and between upper end portions of the wall panels, reclosable zipper means including complementary interengagable zipper profiles located substantially below the upper ends of the upper end portions and responsive to digital closing pressure for attaining a closed condition of the zipper means for closing the mouth, the zipper means being openable responsive to digital pull-apart force for opening the bag mouth to gain access into contents reserving space within the bag, non-reclosable closure means located in spaced adjacency to the reclosable zipper means for initially maintaining the bag mouth arrangement closed independently of the zipper means, and the non-reclosable closure means being openable by pull-apart force when the reclosable zipper means is open.

BRIEF DESCRIPTION OF THE DRAWINGS

Other objects, features and advantages of the present invention will be readily apparent from the following description of representative embodiments thereof, taken in conjunction with the accompanying drawings, although variations and modifications may be effected without departing from the spirit and scope of the novel concepts embodied in the disclosure, and in which.

DETAILED DESCRIPTION

Figure 1:
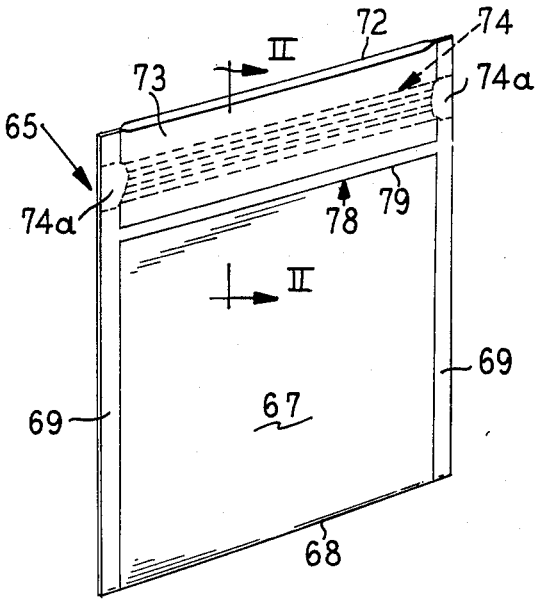
FIG. 1 is a perspective view of a bag structure embodying the invention.
Figure 2:
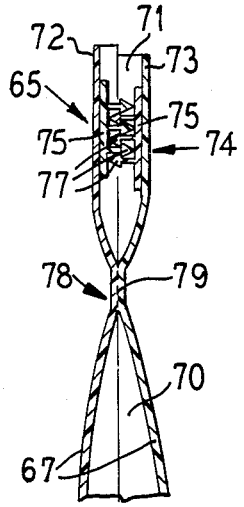
FIG. 2 is a fragmental vertical sectional detail view taken along the line II—II in FIG. 1.

As shown in FIGS. 1 and 2, a bag 65 comprises wall panels 67 at least adapted to be connected together at a bottom end 68 and connected together at side edges 69, thereby providing a contents receiving receptacle space 70 having a mouth 71 at the top of the bag defined between upper end portions of the wall panels 67 which provide pull flanges 72 and 73, and wherein the pull flange 72 is desirably somewhat longer than the pull flange 73 for convenient digital accessibility.

Reclosable zipper means 74 at the upper end portions of the wall panels 67 and more particularly adjacent to the pull flanges 72 and 73 comprises, in FIGS. 1 and 2, complementary extruded plastic profiled fastener strips 75, one of which is permanently connected to the inside surface of the upper end portion of one of the wall panels 67, and the other of which is permanently connected to the inside surface of the upper end portion of the other of the wall panels 67. The fastener zipper strips 75 are properly aligned with one another across the entire width of the bag so that generally arrow-shaped releasably interlockable complementary profiles 77 can be interlocked by digital pressure applied inwardly, i.e. toward the strips 75, on the outer faces of the wall panel areas in line with the fastener strips. The fastener strips 75, and more particularly the profiles 77, can be pulled apart by pull apart manipulation of the pull flanges 72 and 73.

In a preferred construction, the opposite ends of the zipper strips 75 are sealed as by spot seals **74*a* into the side edges 69 of the bag 65**.

Inwardly, that is downwardly, adjacent to the reclosable zipper 74, there is a one time openable non-reclosable closure means 78, conveniently comprising a peel seal 79 for initially maintaining the mouth 71 closed independently of the zipper 74. Thus, the bag 65 will be maintained closed in a tamper evident manner until the zipper 74 is opened, and pull-apart force applied to the non-reclosable peel seal 79 to open the same. Thereafter, the bag can be intermittently closed by means of the reclosable zipper 74.

Figure 3:
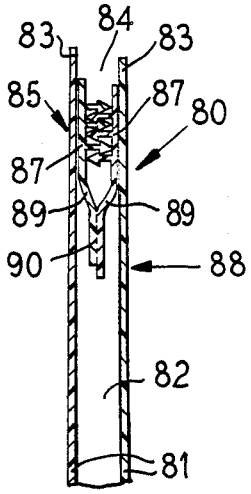
FIGS. 3–7 are fragmentary vertical sectional detail views similar to FIG. 2 and showing various modifications embodying the invention and disclosing various combinations of zipper and non-reclosable fastener means.

FIG. 3 discloses a bag 80 which is a modification of the bag 65 in FIG. 1. Herein, the bag 80 has wall panels 81 closed or at least closable along the bottom and side edges of the bag similarly as the bag 65 and providing a receptacle space 82. At the upper end portions of the wall panels 81, pull flanges 83, one of which may be longer than the other, define therebetween a bag mouth 84. Inwardly adjacent to the pull flanges 83 is a zipper 85 in the form of complementary extruded plastic multi-profile fastener strips 87 substantially the same as the fastener strips 75 in FIG. 10. In this instance, non-reclosable closure means 88 located inwardly relative to the zipper 85, comprises inwardly, that is downwardly, extending flange extensions 89 from the inner sides of the fastener strips 87. The flange extensions 89 are initially sealed together by a peel seal 90 for maintaining the mouth 84 closed independently of the reclosable zipper 85. When it is desired to open the bag 80 for access into the space 82, the zipper 85 is opened by pull-apart digital force applied to the pull flanges 83. By continuing the pull-apart force, the non-reclosable closure means 88 can be opened by the pull-apart force peeling the seal 90 apart. Intermittent closing of the bag 80 can then be effected by reclosing the reclosable zipper 85.

Figure 4:
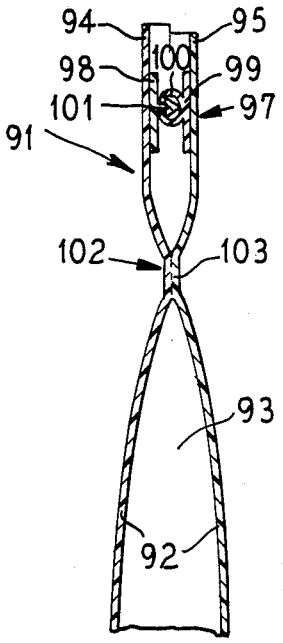

In FIG. 4 is shown a bag 91 which is a modification of the bag of FIGS. 1 and 2. Wall panels 92 closed or at least closable at bottom and side edges define a receptacle space 93. At their upper end portions the wall panels 92 provide pull flanges 94 and 95. Along the lower ends of the pull flanges 95, a reclosable zipper 97 comprises extruded plastic reclosable fastener strips 98 and 99, one of which is secured to one of the wall panels 92 and the other to the other wall panel 92. In this instance, the reclosable fastener strip 99 carries an extruded generally groove-shaped profile 100 within which is releasably interlockably received a complementary generally arrowhead shaped profile 101 on the fastener strip 98. Below the reclosable zipper 97 is provided non-reclosable closure means 102 comprising a peel seal 103. Opening and closing of the bag 91 is effected similarly as described for the bags 65 and 80.

Figure 5:
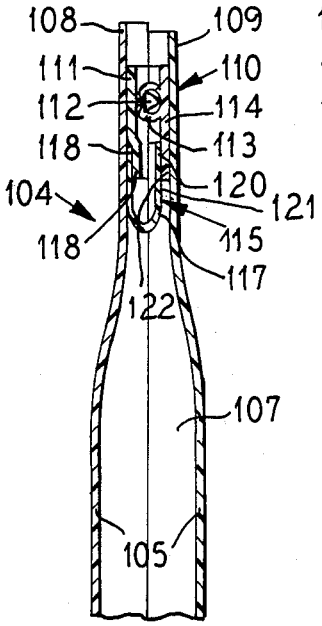

FIG. 5 depicts a bag 104 which, in effect, is a modification of the bag 80. Side wall panels 105 define therebetween a receptacle space 107. At the upper end of the bag 104 there is a pull flange 108 on one of the wall panels 105 and a pull flange 109 on other of the wall panels 105. At the lower ends of the pull flanges 108 and 109 a reclosable zipper 110 comprises extruded plastic fastener strips wherein the fastener strip 111 is secured at the bottom or lower end of the pull flange 108 and has generally arrow-shaped profile 112 which cooperates in releasable snap together, pull-apart relation with a groove-shaped complementary profile 113 of a fastener strip 114 secured at the bottom or lower end of the pull flange 109. Non-reclosable closure means 115, comprises a web 117 which has one margin 118 sandwiched between a downwardly, that is inwardly, extending flange extension 119 of the fastener strip 111 and the contiguous wall panel 105. In this orientation, the margin 118 is permanently secured in place as by heat sealing or adhesive. On the other hand, an opposite margin 120 of the closure web 117 is secured by means of a peel seal 121 to a downwardly or inwardly extending base flange extension 122 of the fastener strip 114. Through this arrangement, when it is desired to open the bag 104, pull-apart force is applied to the zipper 110 to open it. Then continuation of the pull-apart force is applied to peel the peel seal 121 open. The bag can then be intermittently closed by means of the zipper 110.

Figure 6:
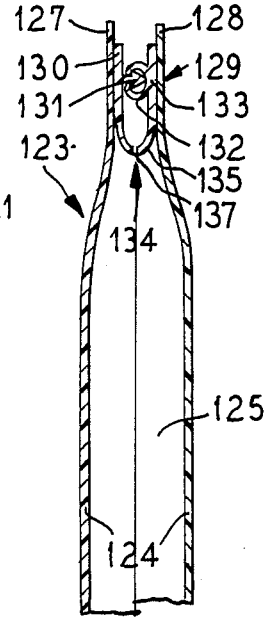

In FIG. 6, a bag 123 is depicted which is a modification of the bags in FIG. 3 and 5. Sidewall panels 124 have their bottom and side edges closed, or at least closable, and define a contents receiving receptacle space 125. One of the sidewall panels 124 provides an upper end portion pull flange 127, and the other panel provides an upper end portion pull flange 128. At the lower ends of the pull flanges 127 and 128 a zipper 129 is provided conveniently comprising a one-piece extruded plastic fastener structure having a fastener strip base portion 130 provided with a generally arrow-shaped rib profile 131 and secured to one wall panel 124 at the lower end of the pull flange 127 and releasably interlockably interengagable within a complementary groove-shaped profile 132 on a fastener strip base portion 133 secured to the other wall panel 124 at the lower end of the pull flange 128. Non-reclosable closure means 134 comprising an integral rupturable web 135 connects the inner edges of the fastener base portions 131 and 133. There may be, if desired, an optional line of weakening 137 such as solid hermetic line of thinning or perforations as may be appropriate for the use to which the bag 123 is to be directed. The weakening 137 desirably extends along the web 135 from side-to-side of the bag. The web 135 retains the bag initially closed but is rupturable along the line of weakening 137 by pull-apart force after the zipper 129 has been opened by pull-apart force. Thereafter, the bag 123 is adapted to be intermittently closable by means of the zipper 129.

Figure 7:
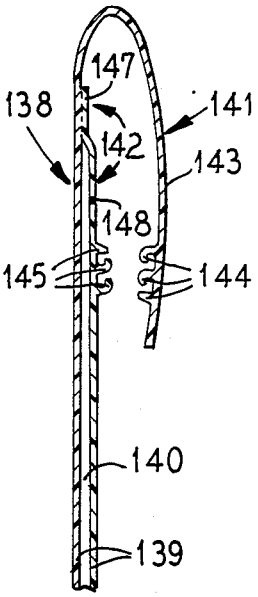

In FIG. 7, a bag 138 has wall panels 139, closed, or at least closable, along their bottom and side edges to define a contents receiving receptacle space 140 into the top mouth portion of which access is controlled by means of a reclosable closure means 141 and non-reclosable closure means 142. The reclosable closure means 141 comprises a flap 143 which is an extension from the upper end of one of the wall panels 139. The flap 143 extends protectively over the top of the bag 138 and then projects down along and overlaps the upper portion of the outerside or face of the other wall panel 139. Carried by the inner side or face of the flap 143 is an arrangement of zipper fastener strip profiles 144 releasably interlockable with complementary zipper strip fastener profiles 145 on the overlapped outer face of the adjacent wall panel 139. These zipper strip profiles 144 and 145 may be integrally extruded parts of the elements carrying them.

For providing a hermetic seal, the closure means 142 comprises a permanent heat or adhesive seal 147 securing the upper end of the wall panel 139 carrying the zipper profiles 145 to the other panel 139 at the base or proximal end of the flap 143. There may be a solid but tearable line of weakening 148, or perforations, whichever may be best for the use to which the bag 141 is to be put, along the upper portion of the wall panel 139 which is overlapped by the flap 143. Through this arrangement, when it is desired to open the bag 138, access to the non-reclosable closure means 142 is gained by opening the flap 143, and digitally ripping the non-reclosable weakening line 148, thereby forming a mouth opening into the bag space 140. Thereafter, for intermittently closing the bag 141, the flap 143 may be reclosed and held closed by digitally closing the zipper 144, 145.

From the foregoing, it will be appreciated that in all forms of the invention the non-reclosable closure means provides a tamper evident device. Throughout all forms of the invention, the digitally reclosable zipper is located substantially below the upper ends of the upper end portions of the bag wall panels. This is an advantageous arrangement enabling the upper end portions of the bag walls to be conveniently manipulated for pull apart opening of the bag.

At least certain of the non-reclosable closures assist in hermetically sealing the associated bags. After any form of the non-reclosable closure means has been opened it will be apparent that access has been gained or attempted to be gained into the bag. Inspection as to whether there has been tampering with the non-reclosable closure means can be easily effected. The reclosable zipper must be opened in order to gain access to the non-reclosable closure means. After the non-reclosable closure means has been opened, intermittent closing of the bag is effected by reclosing the zipper.

Full closure of the contents receiving spaces provided within the bags will be effected after the bags have been filled. For instance, where it is desired to fill the bags through their upper or mouth ends, the peel seal non-reclosable closure means may be closed after the filling. On the other hand, it may be desired to fill the bags through an open side or an open bottom which is sealed after the filling has been accomplished, and in such case the non-reclosable closure means may be sealed, before filling. From the several forms of non-reclosable means and zippers disclosed, it will be apparent that any appropriate combinations thereof may be chosen for various particular needs.

It will be understood that variations and modifications may be effected without departing from the spirit and scope of the novel concepts of the present invention.

We claim as our invention:

1. A bag having opposed wall panels secured together and defining a receptacle space therebetween, and comprising:

a bag mouth defined between upper end portions of said wall panels which extend between opposite sides of the bag;

a one-time openable non-reclosable peel seal closure means extending in a relatively narrow band from side-to-side of the bag and securing said panels together substantially below the upper ends of said upper end portions and initially maintaining said mouth fixedly closed;

reclosable zipper means located below said upper ends of said upper end portions, but above said peel seal closure means and functioning for initially maintaining said upper end portions against access to said non-reclosable peel seal closure means;

said zipper means comprising complementary extruded plastic profiled fastener strips one of which is permanently connected to the inside surface of the upper end portion of one of said wall panels and the other of which is permanently connected to the inside surface of the upper end portion of the other of said wall panels;

said strips having profiles which are reclosably interlockable by digital pressure applied inwardly toward the strips on the outer faces of the wall panel areas in line with the fastener strips, one being adapted to be manually pulled open and reclosed for selectively opening and closing said mouth after said non-reclosable peel seal closure has been opened;

said zipper strips having opposite ends sealed into side edges of said bag;

said reclosable zipper means being openable responsive to digital pull apart force applied to said upper end portions of the wall panels for gaining access to said non-reclosable peel seal closure means; and said non-reclosable peel seal closure means being operable by continuing pull apart force applied to said upper end portions of said wall panels, after said reclosable zipper means has been pulled open, for gaining complete access into said receptacle space, and said reclosable zipper means being thereafter reclosably closable as the sole closure for the bag mouth.

2. A bag according to claim 1, wherein said zipper strips have downwardly inwardly projecting flanges comprising part of said peel seal closure means, and a peel seal securing said flanges releasably.

3. A bag according to claim 1, wherein each of said fastener strips has a plurality of profiles complementary to said releasably interlockably interengagable with the profiles of the other of said strips.

4. A bag according to claim 1, wherein one of said fastener strips has a profile of generally arrow-shape cross section, and the other of said strips has a generally channel shaped profile complementary to and releasably interlockably receptive of said arrow shaped profile.

5. A bag according to claim 1, wherein said fastener strips comprise plastic extrusions formed separately from said wall panels and fixedly secured to said wall panels.

* * * * *